US006685055B2

(12) United States Patent
Taylor

(10) Patent No.: US 6,685,055 B2
(45) Date of Patent: Feb. 3, 2004

(54) FLIP-TOP CONTAINER CLOSURE APPARATUS

(75) Inventor: Steven G. Taylor, Columbus, OH (US)

(73) Assignee: SIG Combibloc Inc., Columbus, OH (US)

( * ) Notice: Subject to any disclaimer, the term of this patent is extended or adjusted under 35 U.S.C. 154(b) by 20 days.

(21) Appl. No.: 09/867,857

(22) Filed: May 30, 2001

(65) Prior Publication Data

US 2002/0014502 A1 Feb. 7, 2002

Related U.S. Application Data

(60) Provisional application No. 60/207,802, filed on May 30, 2000.

(51) Int. Cl.[7] ..... B67D 5/00
(52) U.S. Cl. ..... 222/83; 222/153.14
(58) Field of Search ..... 222/83, 83.5, 88, 222/153.14, 541.6, 556

(56) References Cited

U.S. PATENT DOCUMENTS

| | | | | | |
|---|---|---|---|---|---|
| 4,964,536 | A | * | 10/1990 | Vestering | 222/83 |
| 6,257,449 | B1 | * | 7/2001 | Baerenwald | 222/83 |
| 6,279,769 | B1 | * | 8/2001 | Duvander et al. | 222/83 |
| 6,305,575 | B1 | * | 10/2001 | Wrigley | 222/83 |

* cited by examiner

*Primary Examiner*—Joseph A. Kaufman
(74) *Attorney, Agent, or Firm*—Standley Law Group LLP

(57) ABSTRACT

A container closure apparatus having a base for attachment to the container. The base has an opening for passing the contents of the container. A lever is hinged to the base, such that an upward force on a rearward portion of the lever causes a frontward portion of the lever to depress the container material creating an opening directly beneath the opening in the base. A portion of the lever is adapted to seal the opening in the base, and thus the container, when the lever is in its closed position.

11 Claims, 6 Drawing Sheets

FLIP-TOP CONTAINER CLOSURE APPARATUS

This application claims the benefit of U.S. Provisional Application No. 60/207,802, filed May 30, 2000, which is hereby incorporated by reference in its entirety.

BACKGROUND AND SUMMARY OF THE INVENTION

The present invention relates generally to containers useful for products that may be poured from the container and, more particularly, to improved closures secured to said containers. For example, paperboard cartons are generally well known. A familiar type is the milk carton which has a gabled top. Also, becoming ever more popular are rectangular shaped cartons (e.g., parallelepipedic containers), some of aseptic quality, for containing beverages, powdered goods, viscous food products, and practically any other pourable substance. To prevent waste, provide for ease of pouring, and prevent contamination of the product, improved pour-through closure apparatus for securing openings in the containers are needed. Practically any container for holding pourable contents may benefit from the improved closure of the present invention.

Push-tabs have been used in combination with container closure apparatus, which are designed to be depressed into and through the material of the container. The push-tabs serve to open a partially pre-cut area on the surface of the container below the closure. The push-tab separates the material of the container and serves to hold the material apart to maintain the opening during pouring. These closure push-tabs have generally required that the push-tab be pressed through the partially pre-cut material of the container by a finger or other external object. This often results in contact by a portion of the finger or other object with the material inside the container, which may cause contamination or user frustration.

The present invention provides a pivoting closure apparatus, wherein an opening lever may be lifted by a rear portion, causing a forward portion to pivot or rotate downward and separate the partially pre-cut material from the container. The present invention allows a container to be opened and resealed while minimizing the chance that a finger or other foreign object will contact the material inside the container.

The present invention may also contain a simple but effective device that allows a user of the container to discern whether the container has been previously opened, while still allowing the container to be resealed.

In addition to the novel features and advantages mentioned above, other objects and advantages of the present invention will be readily apparent from the following descriptions of the drawings and exemplary embodiments.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION OF THE EXEMPLARY EMBODIMENT(S)

Figure 1:
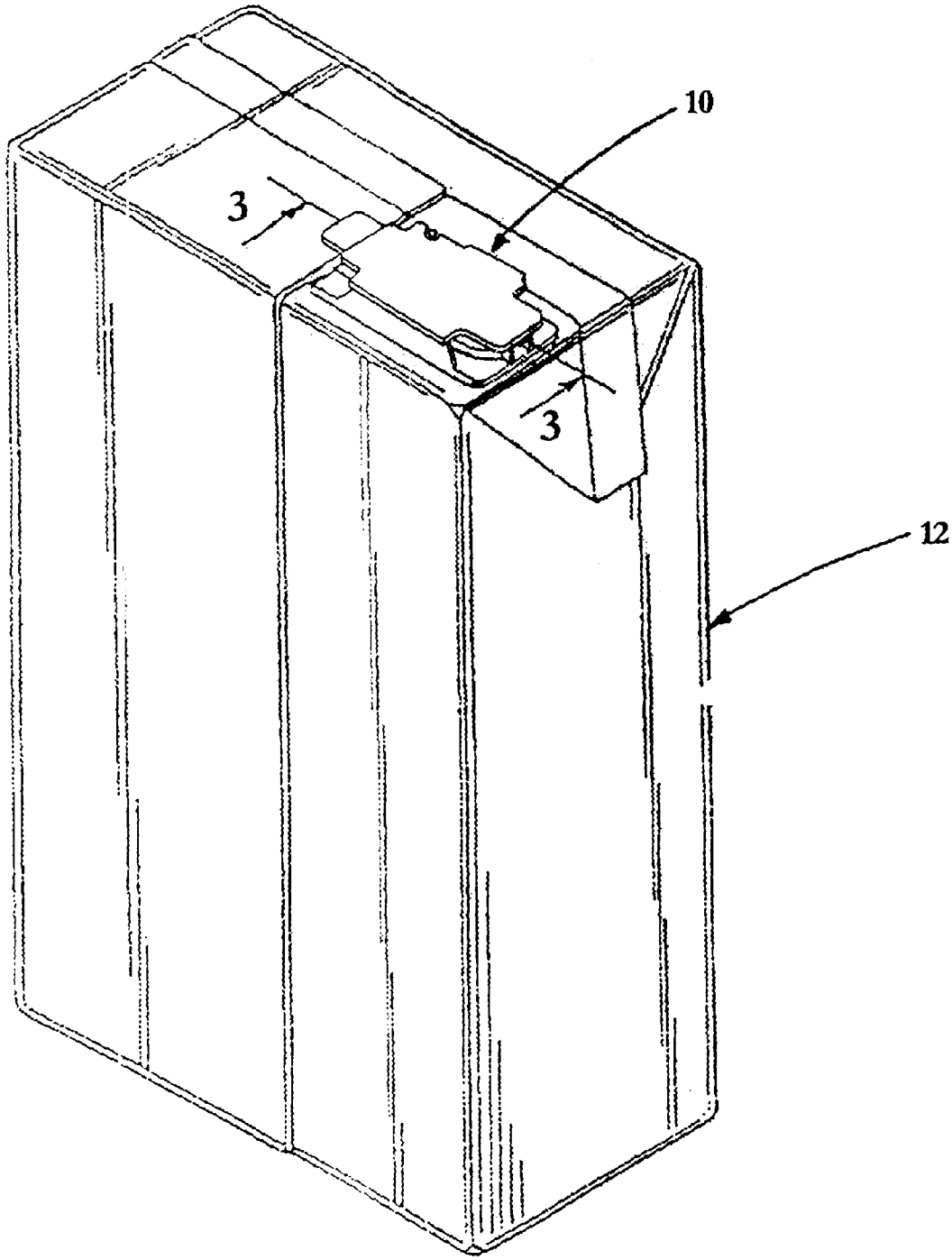
FIG. 1 is a perspective view of one embodiment of the closure apparatus of the present invention attached to the top of a package or container.

Referring now to the drawings, a closure apparatus 10 for opening and resealing a container 12 is shown in FIG. 1. The container 12 may be made from a penetrable material, and may contain a dispensable fluid, powder, particulate solid substance, or any other pourable contents. The container 12 may be a non-aseptic container or an aseptic quality container.

Figure 2A:
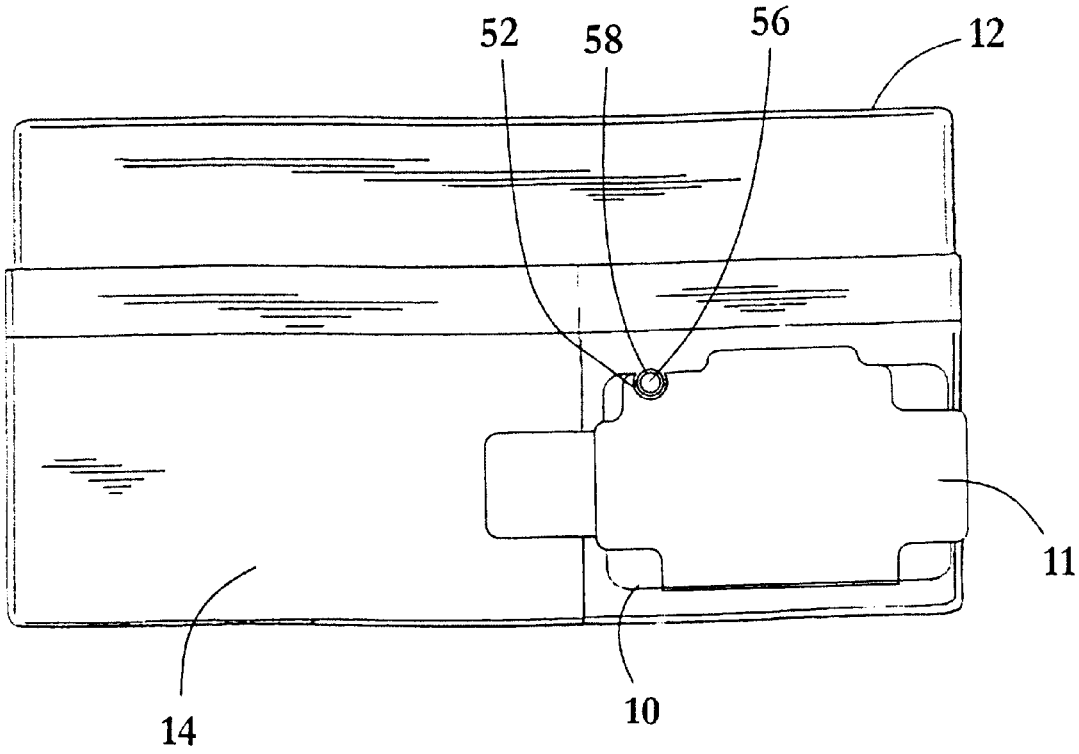
FIG. 2A is a plan view of the closure apparatus of FIG. 1 with the cover in a closed position.

FIG. 2A shows the closure apparatus 10 affixed to the container top 14 with its cover portion 11 in a closed position. In other embodiments, the closure apparatus 10 may be affixed to another portion of a container. For example, the closure apparatus 10 may also be secured to a side or the bottom of a container.

Figure 2B:
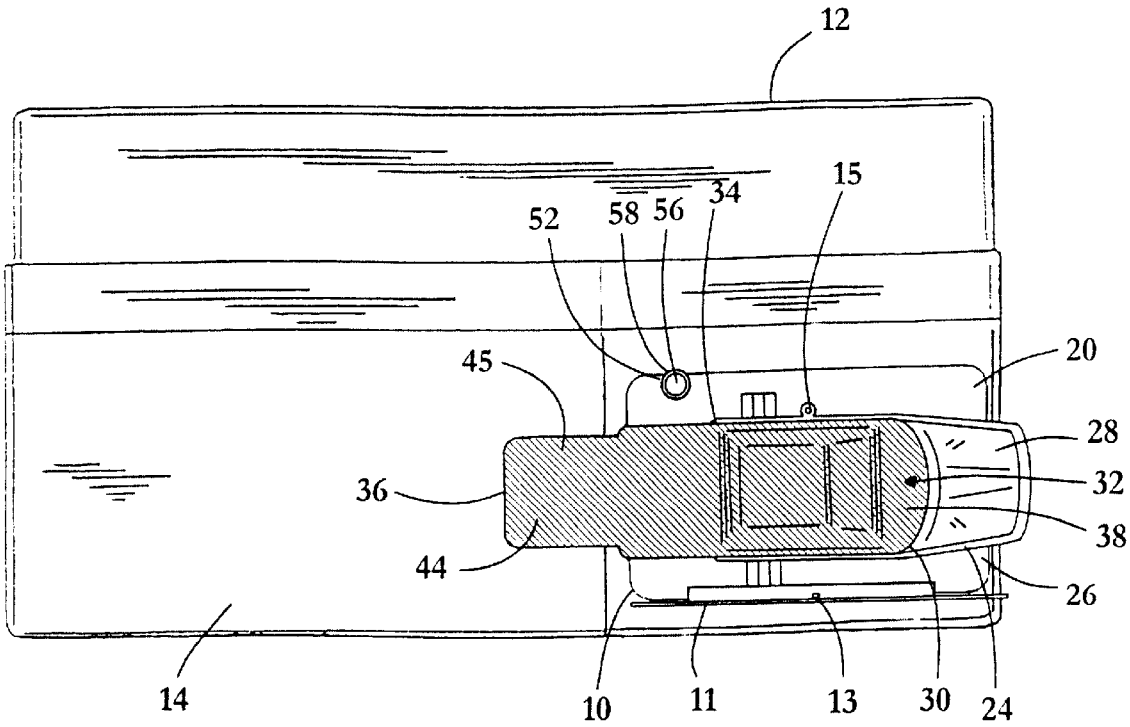
FIG. 2B is a plan view of the closure apparatus of FIG. 1 with the cover in an open position.
Figure 5:
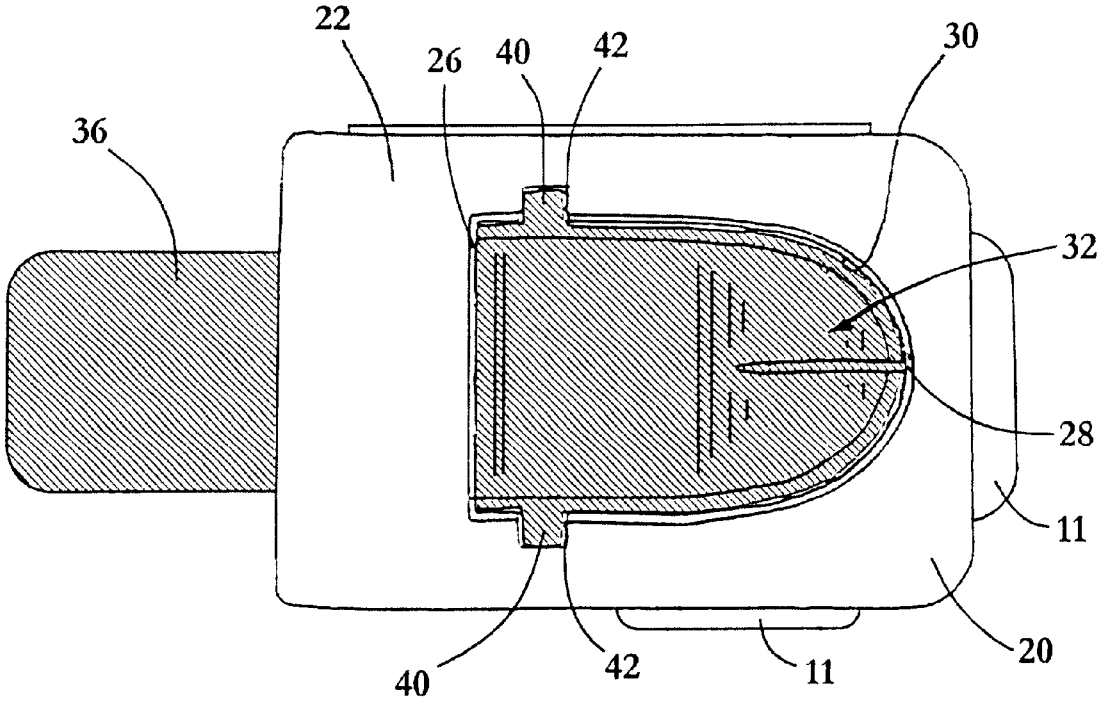
FIG. 5 is a plan view depicting the bottom surface of an exemplary embodiment of the closure apparatus of the present invention.

Referring now to FIG. 2B, the closure apparatus 10 may have a base 20. The base 20 may be affixed to the container top 14 by any suitable means, such as an adhesive applied to its bottom surface 22 (FIG. 5). A wall 24 of the base 20 may extend from a top surface 26 of the base 20. In an exemplary embodiment, as depicted in FIG. 2B, the wall 24 may have any desired shape including, but not limited to, an oval, tapered, or rounded shape. The wall 24 preferably has a forward portion, which may form a spout 28. An inner side wall 30 preferably extends around the periphery of the wall 24, to define an opening 32 through the base 20 of the closure apparatus 10. A section of the wall 24 may be removed from the rearward portion, such that a notch or cutout portion 34 is formed in the wall for receiving an opening lever 36.

The closure apparatus 10 may further include a cover 11. The cover 11 may be hinged to the base 20 and formed as one piece construction with the base 20 in the same forming operation, such as by a suitable or conventional injection molding process using plastic material. The cover 11 may be hinged at one side of the base 20 to avoid interfering with the movement of an opening lever 36. The cover 11 may include a securement device, such as a tab 13 to be snapped in place into a receptacle 15 formed in the base 20. Alternatively, the cover 11 may have a receptacle that is adapted to receive a tab of the base 20. Furthermore, any other desired or suitable securing methods may be employed to maintain the cover 11 in closed position over the base 20 until the user is ready to pour contents from the container 12. The cover 11 serves to protect the opening 32 and a sealing portion 38 of lever 36 from contact with foreign matter or human contact until the user is ready to pour contents from the container 12.

The sealing portion 38 is preferably of substantially the same shape as that of the interior periphery of the wall 24. The sealing portion 38 is preferably made to reside within and substantially against the wall 24 to form a seal. The opening lever 36 may be detachably connected to the wall 24 by two trunnions 40 (FIG. 5) located on either side of the opening lever 36. The trunnions 40 may engage with two notches 42 (FIG. 5) located along the interior of the wall 24, to allow the opening lever 36 to pivot. Nevertheless, it should be recognized that the lever 36 may be pivotally or rotatably connected to the base 20 by any suitable means including, but not limited to, male-female connections, ball and socket connections, belt and pulley connections, chain and sprocket connections, hinge connections, and other similar, suitable, or conventional types of pivotal or rotatable connections that are now known or may be later developed. The opening lever 36 also has a lifting portion 44 which preferably extends rearwardly from the sealing portion 38. The lifting portion 44 may be disposed in the notch 34 when the opening lever 36 is in its closed position, and may further extend substantially past the area of the base 20 (e.g., about a quarter inch or more in extended length), to form a grasping portion 45, to make it easier for a user to grasp the lifting portion 44 and open the container. However, in other embodiments of the present invention, the lifting portion 44 may only extend a little or not at all beyond the base 20 when in the closed position.

Figure 4:
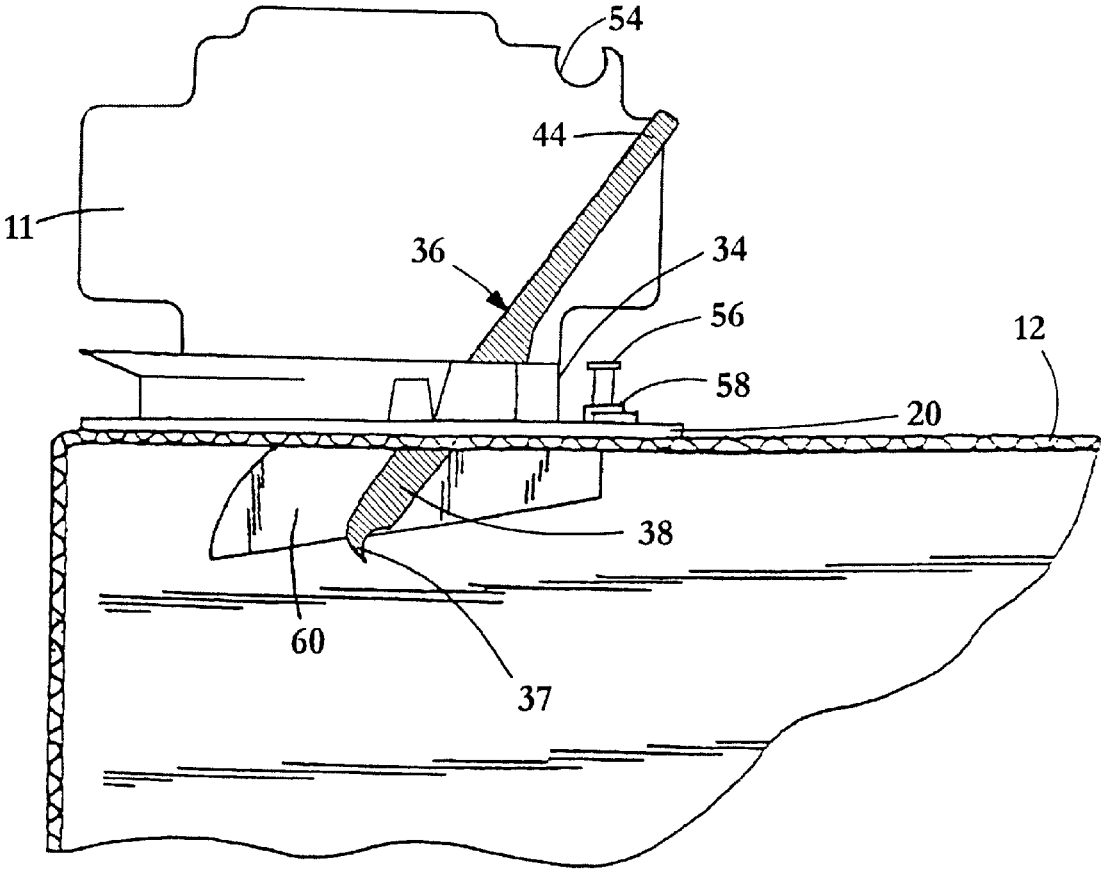
FIG. 4 is a side elevational view illustrating the opening lever in an open position, wherein the container is shown as cut away, allowing a portion of the opening lever and the material of the container top to be observed.

As can be seen in FIG. 4, exertion of an upward force on the lifting portion 44 will cause the opening lever 36 to pivot about the trunnions 40 (FIG. 5), wherein a section of the sealing portion 38 may pass through the central opening in the base 20 and break through the partially pre-cut material 60 of the container 12. The lever 36 may further include at least one beak 37 or teeth to aid in penetrating the material 60. In a preferred embodiment, the beak 37 is well defined to come to a sharp point of about an eight inch or longer, to assist in opening thicker package material.

Figure 3:
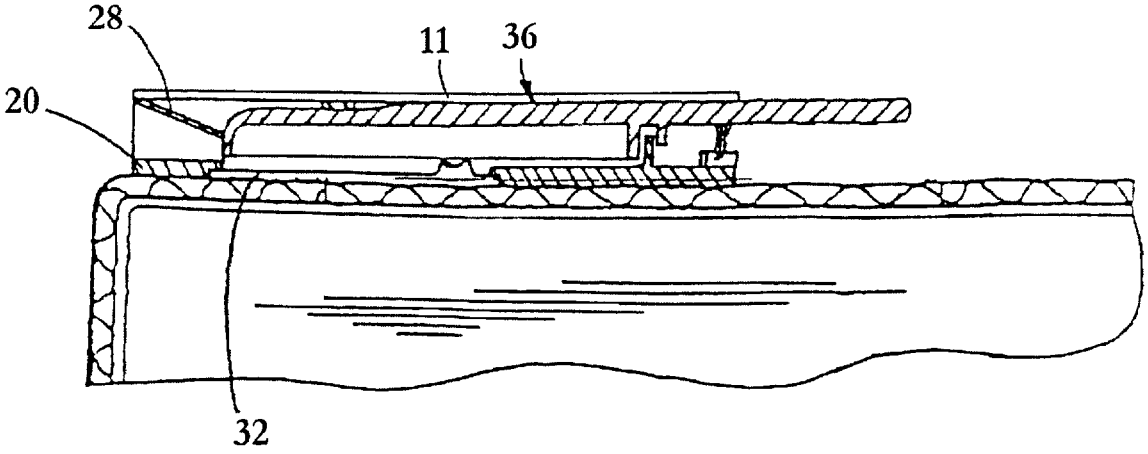
FIG. 3 is an enlarged section view taken along line 3—3 in FIG. 1.

As can be seen in FIG. 5, a backstop 26 may be included in or connected to the base 20 at the rear of the opening 32, under the lever 36, to limit rotation of the opening lever 36, thus preventing the opening lever 36 from being over-rotated and inadvertently covering a portion of the spout 28 with the lifting portion 44. In particular, a bottom surface of the lever 36 may abut against the backstop 26 when the lever 36 is in a completely open position. Use of a backstop 26 provides another benefit: it may eliminate the need for any obstruction through the pour zone of the opening 32 for use in stopping over-rotation of the lever 36 by making contact with a top surface of the lever 36. By eliminating any obstruction in the pour zone of the central opening 32, the pour zone may be larger in area, resulting in greater flow rates of product from the container. In one preferred embodiment of the present invention, the pour zone (that area through which product may flow through the central opening when the lever is in the wide open position against the backstop) is at least about ½ inch (more preferably at least about ⅝ inch and still more preferably at least about 11/16 inch) wide at its widest point, and at least about ½ inch (more preferably at least about ¾ inch and still more preferably at least about 13/16 inch) long (as measured at its longest point, from the front central portion of the pour zone at the spout 28, to the top surface of the lever 36 as the lever 36 rests against the backstop 26). While these dimensions may of course be varied up or down, they are substantially greater than prior pour zones of less than half the area of this preferred embodiment. Nevertheless, it should be recognized that alternative embodiments of the present invention may include an obstruction that extends at least partially over the pour zone. After being moved into an open position, the opening lever 36 may be returned to its closed and sealed position, as illustrated in FIG. 1 and FIG. 3, by exertion of a downward force on the lifting portion 44.

As seen in FIG. 2A and FIG. 2B, the closure apparatus 10 may also contain a tamper resistant device 52. The elements of a preferred embodiment of the tamper resistant device 52 may be seen in FIG. 4. Referring to FIG. 4, a post 56 extends upward from the top surface of the base 20. A ring 58 is detachably attached to a notch 54 (FIG. 4) in the cover 11. The ring 58 is designed to break away from the notch 54 and remain on the post 56 when the cover 11 is lifted into its open position. At assembly, the post 56 may be of a uniform diameter. After closing the cover 11 in place over the base 20, the top of the post 56 may be enlarged by any suitable method, such as by a slight melting, to prevent further removal of the ring 58 from the post 56. Upon opening the cover 11 into its open position for the first time, the ring 58 preferably detaches from the notch 54 and remains on the post 56 as evidence that the cover has been opened.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A flip-top closure apparatus for use on a container having pourable contents, said closure apparatus comprising:

a base defining an opening, said base comprising at least one wall and a post, said post comprising a lower portion having a cross-sectional area and an upper portion, said upper portion having a cross-sectional area greater than said cross-sectional area of said lower portion; and a lever having a sealing portion, wherein said lever is hinged to said base, such that an upward force on a rearward portion of said lever will cause a frontward portion of said lever to depress into said container, creating an opening therein beneath said opening of said base, wherein said rearward portion is longer than said frontward portion to facilitate the creation of said opening, said rearward portion of said lever further comprising an annular structure adapted to detach from said rearward portion of said lever, so as to irreversibly indicate that said lever has been actuated, as said upward force is applied to said rearward portion of said lever, said annular structure having an opening whose cross-sectional area is greater than said cross-sectional area of said lower portion of said post and less than said cross-sectional area of said upper portion, wherein said sealing portion of said lever forms a seal with said at least one wall of said base.

2. The flip-top closure apparatus of claim 1 wherein said sealing portion of said lever is adapted to seal said opening in said base when said lever is in a closed position.

3. The flip-top closure apparatus of claim 1 wherein said lever includes an extended grasping portion extending past the base at least about one-quarter inch.

4. The flip-top closure apparatus of claim 1 further comprising a structure to limit rotation of said lever.

5. The apparatus of claim 4, wherein said structure is a backstop formed at a rear portion of said opening in said base.

6. The flip-top closure apparatus of claim 1 further comprising a spout formed on said base at a pouring edge.

7. The apparatus of claim 1, further comprising a cover movably secured to said base.

8. The apparatus of claim 1, wherein when said apparatus is in an open position, said opening defines an unobstructed pour zone, said pour zone having a width dimension of at least about ½ inch at its widest point and a length dimension of at least about ½ inch at its longest point.

9. The apparatus of claim 1, wherein when said apparatus is in an open position, said opening defines an unobstructed pour zone, said pour zone having a width dimension of at least ⅝ inch at its widest point and a length dimension of at least ¾ inch at its longest point.

10. The apparatus of claim 1, wherein said lever includes a sharp pointed beak, at least about one eighth inch in length, to penetrate container material.

11. A flip-top closure apparatus for use on a container having pourable contents therein, said flip-top closure apparatus comprising:

a base defining an opening through which said pourable contents flow, said base comprising at least one wall and a post comprising a lower portion having a cross-sectional area and an upper portion, said upper portion having a cross-sectional area greater than said cross-sectional area of said lower portion, a lever having a sealing portion rotatably secured to said base so as to regulate flow of said pourable contents through said opening such that said an upward force on a rearward portion of said lever causes said lever to rotate about an axis thereby disengaging said sealing portion located on a forward portion of said lever from at least one said wall thereby opening said container; and a cover rotatably secured to said base such that said cover has an axis of rotation approximately perpendicular to said axis of said lever, said cover comprising an annular structure opposite said axis of rotation of said cover adapted to detach from said rearward portion of said lever, so as to irreversibly indicate that said cover has been rotated away from said post, said annular structure having an opening whose cross-sectional area is greater than said cross-sectional area of said lower portion of said post and less than said cross-sectional area of said upper portion of said post.

* * * * *